United States Patent [19]

Crothers et al.

[11] 4,091,973

[45] May 30, 1978

[54] DRAPERY PLEATER STEAMER

[75] Inventors: Harry Crothers; Sidney R. Lockley, both of New Castle, Pa.

[73] Assignee: Harry Crothers, New Castle, Pa.

[21] Appl. No.: 798,645

[22] Filed: May 19, 1977

[51] Int. Cl.[2] ..... A41H 43/00

[52] U.S. Cl. ..... 223/28

[58] Field of Search ..... 223/28, 30, 32, 33, 223/29, 70

[56] References Cited

U.S. PATENT DOCUMENTS

| | | | |
|---|---|---|---|
| 3,154,228 | 10/1964 | Klint | 223/32 |
| 3,315,852 | 4/1967 | Getchell et al. | 223/28 X |
| 3,424,356 | 1/1969 | Getchell et al. | 223/32 |

*Primary Examiner*—George H. Krizmanich

*Attorney, Agent, or Firm*—Webster B. Harpman

[57] ABSTRACT

A device that steams and sets the pleats formed in draperies supports the drapes in vertical position and moves steam and vacuum pipes vertically relative thereto. Pleating fingers may be incorporated with the steam and vacuum pipe apparatus to simultaneously form the pleats and steam and set the same.

5 Claims, 7 Drawing Figures

DRAPERY PLEATER STEAMER

BACKGROUND OF THE INVENTION

1. Field of the Invention

This invention relates to devices that mechanically pleat draperies and sets the pleats formed therein.

2. Description of the Prior Art

Prior drape pleaters have positioned the drapes to be pleated both horizontally and vertically and have incorporated means such as fingers movable relative to the drapes or arranged so that the drapes are movable relative thereto for impressing the desired pleats in the drapery material. Heretofore steam wands have been used in connection with such drapery pleaters to attempt to set the pleats being formed.

Machines positioning the drapery material horizontally and mechanically forming pleats therein may be seen in U.S. Pat. Nos. 2,759,273 and 3,147,895. A drapery pleating and pressing machine arranged to steam the drapery being pleated may be seen in U.S. Pat. No. 3,154,228 wherein the drapery material is positioned horizontally and the drape is moved relative to the pleating members. The steam is applied through a manual steam jet pipe. U.S. Pat. No. 3,315,852 positions the drape to be pleated in a vertical frame which is adjustable for drapery lengths and moves the frame and the drape into a housing.

The drapery pleater steamer disclosed herein may be used in conjunction with an existing vertically operating drapery pleater or drapery pleating fingers or loops may be added thereto as desired.

SUMMARY OF THE INVENTION

A drapery pleater steamer comprises a vertically standing frame, the upper portion of which is telescopically adjustable and from which a drape to be steamed so as to set the pleats therein can be suspended. Steam and vacuum pipes are positioned in the vertical frame for vertical movement relative thereto so that they can be moved upwardly and downwardly adjacent the drape being steamed and dried so as to set the pleats therein and means is provided for effecting such upward and downward travel of the steam and vacuum pipes. Pleating fingers on an appropriate support movable with the steam and vacuum pipes enable the machine to both form and set pleats in draperies.

DESCRIPTION OF THE PREFERRED EMBODIMENT

Figure 1:
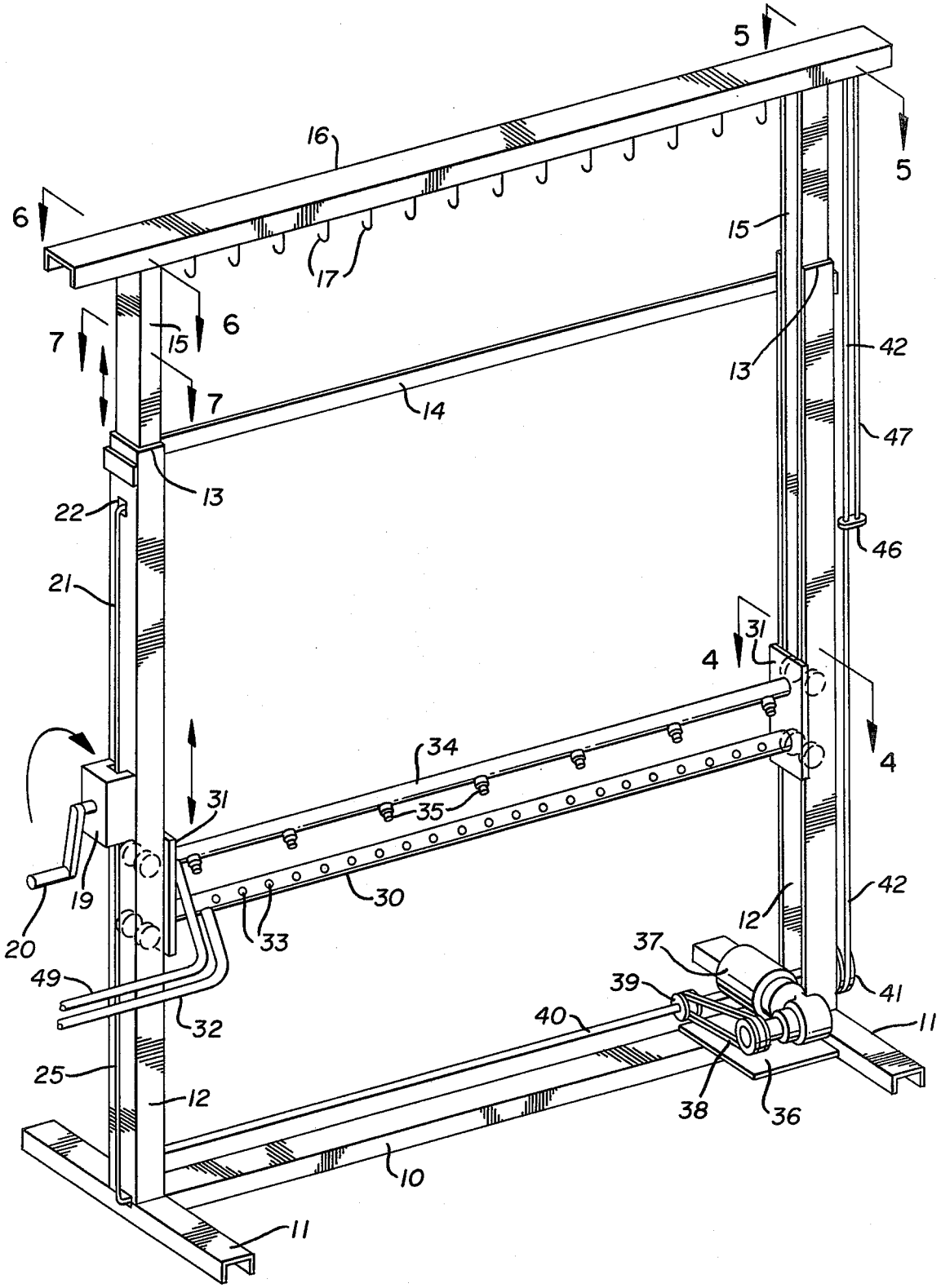
FIG. 1 is a perspective elevation of a drapery pleater steamer embodying the present invention.

In the form of the drapery pleater steamer chosen for illustration herein, the device includes a base having a main transverse frame 10 with T-shaped supports 11 on its opposite ends and vertical frame members 12 positioned on the ends thereof and extending upwardly thereabove. The vertical frame members 12 are U-shaped channels arranged in oppositely disposed relation, they are open at their upper ends 13 and are held in spaced horizontal relation by a secondary transverse frame 14. Secondary vertical frame members 15 are telescopically positioned in the frame members 12 for movement relative thereto and an upper transverse frame 16 is secured to the uppermost ends of the secondary vertical frame members 15 and is provided with a plurality of depending hooks 17 from which a pleated drape may be suspended.

If desired a similar arrangement of oppositely disposed hooks may be positioned on the main transverse frame 10 so that the lower end of a drape can be secured thereto.

Figure 2:
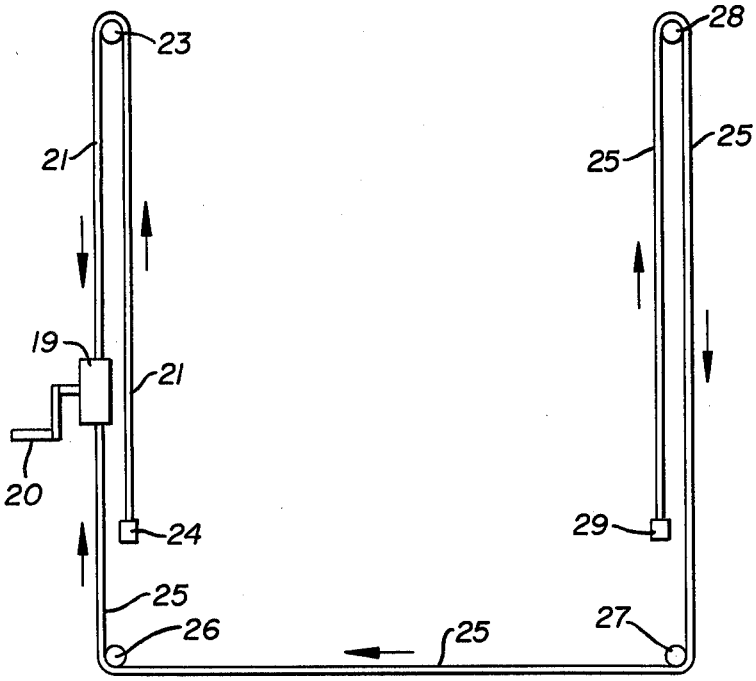
FIG. 2 is a plan view of the cable arrangement for moving the upper portion of the device of FIG. 1 vertically.

Still referring to FIG. 1 of the drawings, it will be seen that a winch and housing 19 is positioned on one of the vertical frame members 12 and provided with a crank 20 for actuation. A cable 21 extends out of the upper side of the winch housing 19 and into an opening 22 near the upper end of the vertical frame member 12 on which the winch housing 19 is positioned where the cable 21 is trained over a pulley 23 as best seen in FIG. 2 of the drawings and by referring thereto it will be seen that the cable 21 then extends downwardly to a fastener 24 engaged on the lower end of one of the secondary vertical frame members 15. A second cable 25 also operated by the winch in the winch housing 19, extends downwardly and through an opening in the bottom of the vertical frame member 12 carrying the winch housing 19 and is trained over a second pulley 26 and it then extends across the base of the drapery pleater steamer preferably within the main transverse frame 10 and is trained over a third pulley 27 from whence it extends upwardly within the other vertical frame member 12 and over a fourth pulley 28 and then downwardly therefrom to a fastener 29 on the lower end of the other secondary vertical frame member 15. It will thus be seen that when the crank 29 is revolved in one direction the winch in the winch housing 19 winds up the cables 21 and 25 thereby moving the fasteners 24 and 29 and the secondary vertical frame members 15 upwardly and that a reverse motion imparted the winch in the housing 19 moves the secondary vertical frame members 15 downwardly. Friction catches or ratchets within the winch housing 19 act to hold the same in any predetermined setting.

By referring again to FIG. 1 of the drawings, it will be seen that a transversely positioned steam pipe 30 is positioned between a pair of vertically movable carriages 31 and placed in communication with a flexible hose 32 by means of which steam from a source not shown is directed into the steam pipe 30. A plurality of openings 33 in the steam pipe 30 permit the steam delivered thereto to move outwardly and into engagement with the drape positioned in the machine as aforesaid and thoroughly steam the same. A vacuum pipe 34 also carried by the carriages 31 is positioned in spaced relation to the steam pipe 30 and incorporates a plurality of longitudinally spaced fittings 35 defining openings through which the steam is exhausted after having set the pleats in the drapery in the device.

Figure 3:
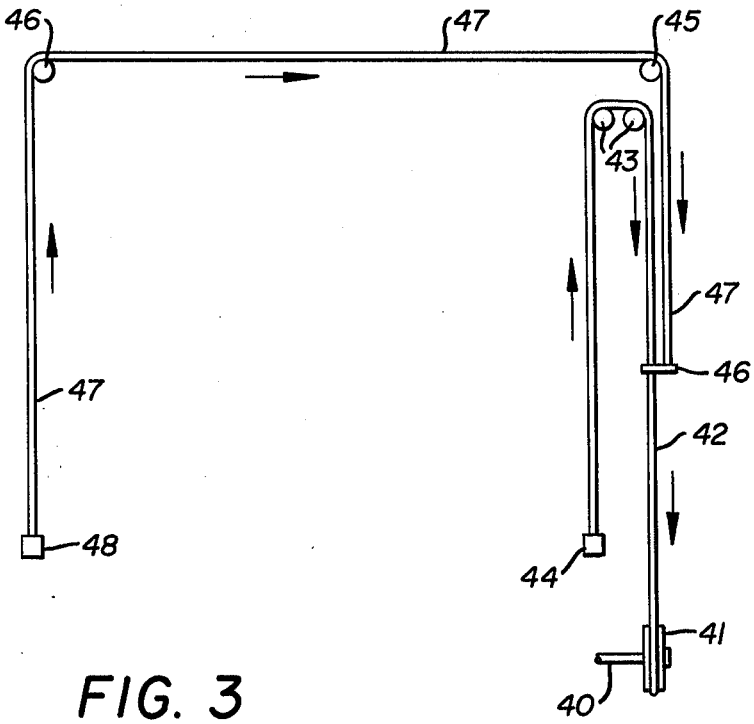
FIG. 3 is a plan view of a cable arrangement for moving the steam and vacuum pipes vertically in the device seen in FIG. 1.

Means for moving the carriages 21 vertically so as to progressively move the steam delivering and exhausting means vertically relative to the drape being treated is provided and may be seen by referring to FIGS. 1 and 3 of the drawings.

In FIG. 1 of the drawings a platform 36 is positioned on the main transverse frame 10 and supports a motor and gear reduction unit 37. The rear reduction unit drives a belt 38 which in turn is trained over a drive pulley 39 on a shaft 40 which is positioned transversely of the device and journaled in the vertical frame members 12. A drum 41 is positioned on one end of the shaft 40 and a cable 42 is secured thereto and extends upwardly therefrom and as seen in FIG. 3 of the drawings, is trained over a pair of idlers 43 in the upper transverse frame 16 from which the cable 43 depends to a fastener 44 secured to one of the carriages 31.

Still referring to FIGS. 1 and 3 of the drawings, it will be seen that the cable 47 which is joined to the cable 42 by the coupling 46 also extends upwardly and over an idler 45 which may be positioned alongside one of the idlers 43 and then extends transversely in the upper transverse frame 16 to a second idler 46 at the opposite end thereof and then downwardly to a fastener 48 on the other carriage 31. Controls not shown are provided for the motor 37 of the motor and gear reduction unit so that running it in one direction moves the carriages 31 upwardly relative to the vertical frame members 12 and 15 and moving it in the other direction moves the carriages 31 downwardly relative thereto. Thus the steam pipe 30 and the vacuum pipe 34 can be moved progressively upwardly and downwardly along the surface of the drape in the machine in which the pleats are being set. A vacuum hose 49 communicates with the vacuum pipe 34 and with a vacuum cleaner or the like which will create a negative atmospheric pressure in the vacuum pipe 34 and the same is preferably vented at a point distant with respect to the vacuum pipe 34.

Figure 4:
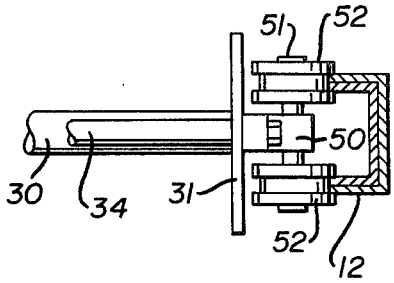
FIG. 4 is a horizontal section on line 4—4 of FIG. 1.

By referring now to FIG. 4 of the drawings, it will be seen that the carriage 31 illustrated therein has a frame 50 with axles 51 on which pairs of spaced grooved wheels 52 are journaled. These grooved wheels ride the longitudinal edges of the channel-shaped vertical frame members 12.

Figure 5:
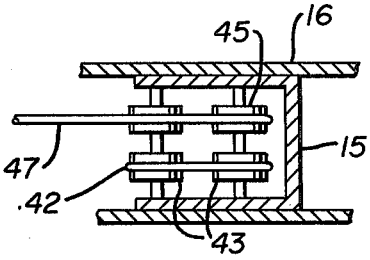
FIG. 5 is a horizontal section on line 5—5 of FIG. 1.

By referring now to FIG. 5 of the drawings, the arrangement of the idlers 43 and 45 may be seen and their relation to their support and positioning of the cables 42 and 47.

Figure 6:
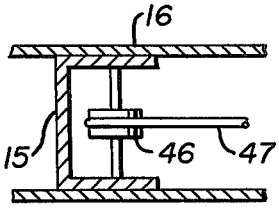
FIG. 6 is a horizontal section on line 6—6 of FIG. 1.

In FIG. 6 of the drawings, the idler 46 may be seen journaled in the upper end of the other one of the secondary vertical frame members 15 just below the upper transverse frame 16 and the cable 47 is shown in position thereover.

Figure 7:
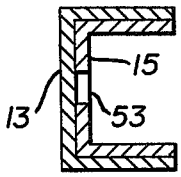
FIG. 7 is a horizontal section on line 7—7 of FIG. 1.

In FIG. 7 a cross section shows the vertical frame member 12, the telescopically arranged secondary vertical frame member 15 and illustrates a vertical slot 53 therein through which the cable 21 passes when the secondary vertical frame member 15 moves downwardly alongside the same. The same construction occurs in the other one of the vertical frame members 12 to provide clearance for the cable 25.

It will thus be seen that a drapery pleater steamer has been disclosed which will secure a pleated drape in desirable position and set the pleats by the automatic traversing of the drape by the steam and vacuum sources moving relative thereto.

It will also occur to those skilled in the art that if desired a pleat former in the form of fingers or other pleat forming configurations as known in the art may be positioned in parallel relation to the steam and vacuum pipes 30 and 34 so that pleats may be impressed in the drapery material as well as set and dried by the device of the invention.

Although but one embodiment of the present invention has been illustrated and described, it will be apparent to those skilled in the art that various changes and modifications may be made therein without departing from the spirit of the invention and having thus described our invention,

What we claim is:

1. A drapery pleater steamer comprising a vertically standing frame and a secondary vertical frame movable vertically relative thereto, horizontally disposed apertured steam and vacuum pipes and means supporting the same arranged for vertical movement relative to said vertical frame, steam and vacuum supply sources, hoses connecting said steam and vacuum supply pipes with said sources and secondary means for moving said steam and vacuum pipes and their support means vertically relative to said vertical frames and a drapery supported thereby.

2. The drapery pleater steamer set forth in claim 1 and wherein said means supporting said apertured steam and vacuum pipes comprises carriages engaging oppositely disposed surfaces of said vertically standing frame and said secondary vertical frame.

3. The drapery pleater steamer set forth in claim 1 and wherein said horizontally disposed apertured steam and vacuum pipes are spaced vertically with respect to one another and wherein the apertures therein are on substantially the same sides thereof.

4. The drapery pleater steamer set forth in claim 1 and wherein said secondary vertical frame is telescopically engaged in said vertically standing frame, a winch positioned on said vertically standing frame, idlers on said vertically standing frame and cables extending from said winch over said idlers and attached to said secondary vertical frame and arranged to raise and lower said secondary vertical frame relative to said vertically standing frame responsive to actuation of said winch.

5. The drapery pleater steamer set forth in claim 1 and wherein said means for supporting said horizontally disposed apertured steam and vacuum pipes comprise carriages movable along said vertically standing frame, a motor and gear reduction unit on said vertically standing frame and a drum arranged for rotation thereby, at least one cable on said drum, idlers on said secondary vertical frame, said cable trained over said idlers and engaged on at least one of said carriages whereby actuation of said motor and gear reduction unit revolves said drum to move said cable and said carriage attached thereto whereby said apertured steam and vacuum pipes are moved vertically relative to said frames.

* * * * *